United States Patent [19]

Efinger

[11] Patent Number: 4,578,550

[45] Date of Patent: Mar. 25, 1986

[54] ELECTRICAL, MEDIUM VOLTAGE, SWITCHING MECHANISM

[75] Inventor: Arnold Efinger, Trossingen, Fed. Rep. of Germany

[73] Assignee: Wickmann-Werke Böblingen GmbH, Böblingen, Fed. Rep. of Germany

[21] Appl. No.: 676,070

[22] Filed: Nov. 29, 1984

[30] Foreign Application Priority Data

Nov. 29, 1983 [DE] Fed. Rep. of Germany ..... 3343099

[51] Int. Cl.[4] ..... H01H 33/66

[52] U.S. Cl. ..... 200/144 B; 200/145; 200/148 H; 200/150 C; 361/120; 361/131; 361/335

[58] Field of Search ..... 200/145, 144 B, 150 C, 200/148 H; 361/340, 335, 120, 131

[56] References Cited

U.S. PATENT DOCUMENTS 4,320,311 3/1982 Avocat ..... 361/340

*Primary Examiner*—Robert S. Macon

*Attorney, Agent, or Firm*—Becker & Becker, Inc.

[57] ABSTRACT

An electrical, medium voltage, switching mechanism which includes a casing having an insulating material filling. In the casing, between a cable connection and a bus bar, a change-over switch, which can alternately switch between a phase contact and a ground contact, follows a load disconnector which is in the form of a vacuum switching tube. An axially displaceable shaft is provided which is displaceable relative to the load disconnector and is rotatable relative to the change-over switch. The bus bar passes through an insulator at right angles thereto. The associated through passage in the insulator is widened into a slot, the length of which permits the switching movements of the load disconnector. The insulator is divided into an insulator core and an insulator casing which is rotatably mounted on the insulator core. In the region of the insulator casing, the through passage is further widened into two sector windows which have an angular aperture which permits the switching movements of the rotary contact of the change-over switch. As a result, the switching mechanism has a structural form which at high operational reliability requires little space, is economical to manufacture, and can be serviced in a time saving manner.

9 Claims, 3 Drawing Figures

ELECTRICAL, MEDIUM VOLTAGE, SWITCHING MECHANISM

BACKGROUND OF THE INVENTION

The present invention relates to an electrical, medium voltage, switching mechanism, which includes a casing having a gaseous or liquid insulating material filling; in the casing, between a cable connection and a bus bar, a change-over switch, which can alternately switch between a phase contact and a ground contact, follows a load disconnector, which is in the form of a vacuum switching tube, and has a fixed contact piece and an axially movable cooperating contact piece which is connected via an insulator with an actuating element.

A switching mechanism of this type operates without a separate actual grounding switch, and includes the load disconnector in the grounding effect in that after the switching of the change-over switch from the phase contact to the ground contact, the two contact portions of the load disconnector are agains joined. A locking means in the actuating mechanism assures that the change-over switch can only be actuated when the load disconnector is open. The change-over switch is therefore partially a phase disconnector which switches free of load, and partially a grounding switch which in the transmitting sense similarly switches free of load. The use of a vacuum switching tube permits a particularly large number of high-energy switching cycles. By including the casing and the insulating material filling, the switching mechanism can be free of service for a protracted period of time, and has great reliability even in a moist, dusty, or otherwise aggressive or corrosive environment.

In connection with an electrical, medium voltage switching field, according to which the entire cable connection is disposed in an air-insulated understructure to which all the phases are common, German Pat. No. 28 18 905 discloses the successive arrangement in an insulating gas filled metal casing, of a vacuum switching tube and a standard disconnector between a cable connection and a bus line. Via an insulating material plate, the vacuum switching plate is centrally disposed at the lower end of a tubular container; in contrast, the disconnector is disposed in a second container which contains the bus bar. Despite the object of wanting to be able to service the switching field in an advantageous manner, and to be able to keep the insulating gas volume of the switching field casing small, for the removal and installation of the two switches into and out of the insulating gas filled casing can only be handled in stages while consuming a lot of time, and the two lateral introductions of the switch drives or controls, in addition to requiring a complicated container shape, also require a proportionately large amount of space.

It is an object of the present invention, for an electrical, medium voltage, switching mechanism of the aforementioned general type, to provide a type of construction which has a high operating reliability but requires little space, is economical to manufacture, and can be serviced in a manner which saves time.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
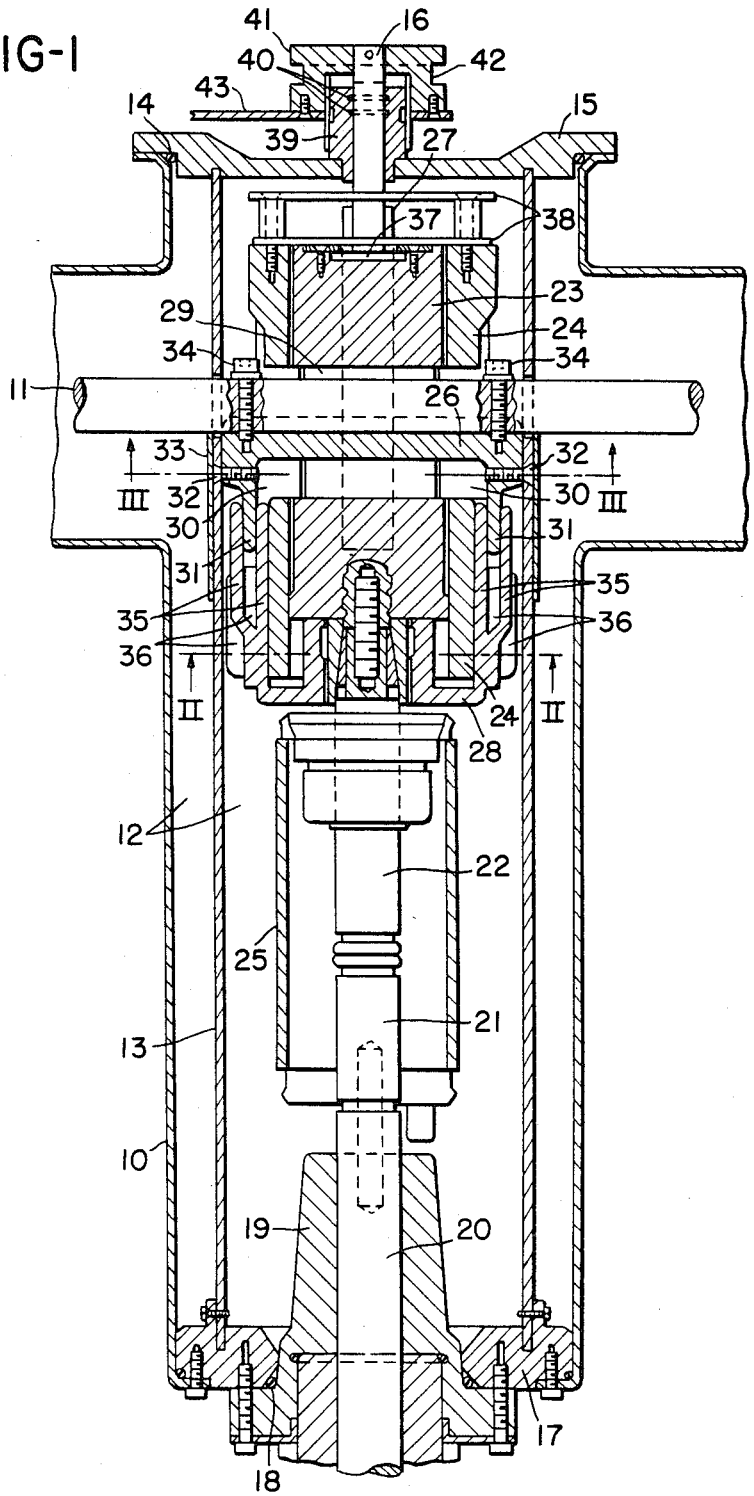
FIG. 1 is a longitudinal section through one embodiment of the inventive switching mechanism.
Figure 2:
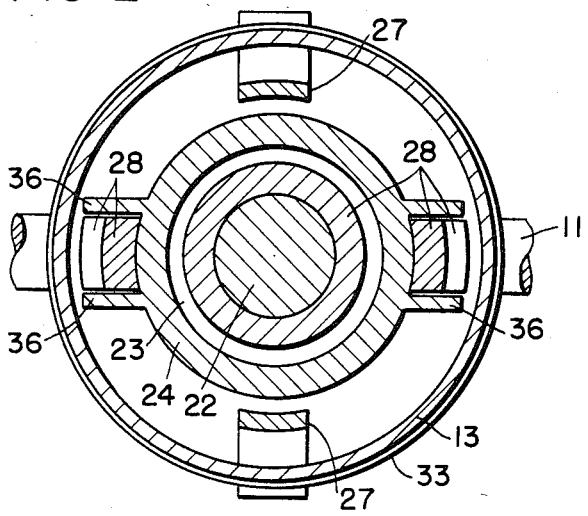
FIG. 2 is a section taken along the line II—II in FIG. 1.
Figure 3:
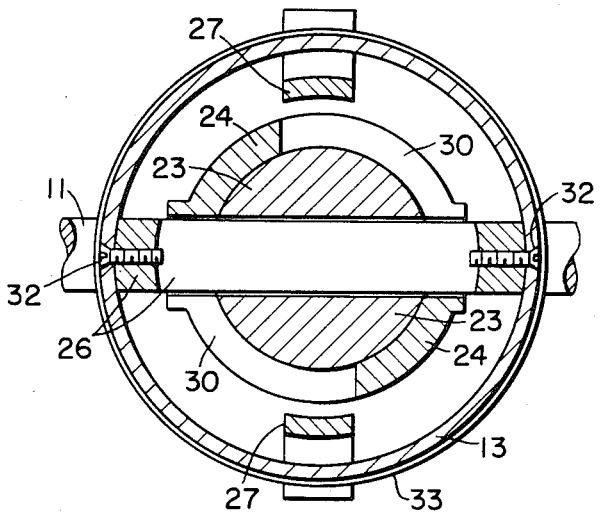
FIG. 3 is a section taken the line III—III in FIG. 1.

The switching mechanism of the present invention is characterized primarily by the provision of a common actuating element for both the load disconnector and the change-over switch, with this common actuating element being in the form of an axially displaceable shaft which is displaceable relative to the load disconnector and is rotatable relative to the change-over switch.

In this way, laterally projecting container parts can be avoided on a tubular casing, and both switches can be inserted together into the casing or can be removed together from the casing for service purposes. The insulating material filling can be supplemented by a permanent insulating material which precludes the formation of so-called cross lines and hence of corona discharges or disruptive discharges. This permanent insulating material has a position which is coaxial to the outer casing and to the two switches, and is not adversely affected in its protective function by local interruptions. Furthermore, by having a shaft in the casing which is common to both of the switches, a second passage which would have to be sealed off is avoided. The advantages achieved with the present invention, however, consist especially also in the fact that the actuating mechanisms of the load disconnector and of the change-over switch can be disposed very close together, thus leading to a considerable further saving in space.

DESCRIPTION OF PREFERRED EMBODIMENTS

Referring now to the drawings in detail, the switching mechanism which is illustrated includes a casing 10 which essentially comprises a circular cylindrical tube which, near one end, has two branches, each of which coaxially surrounds a portion of the bus bar 11. The casing 10 is preferably welded together from steel plate portions, and therefore has a good electrical conductivity, as a result of which it can be kept everywhere shock proof at ground potential. The insulating oil filling 12 of the switching mechanism is provided as voltage protection, and passes over into the region of the bus bar 11 without a partition. The voltage protection is supplemented by a cylindrical sleeve 13 which comprises electrically insulating material. Along with an intermediate chamber of the casing 10, the cylindrical sleeve 13 accommodates all of the active parts of the switching mechanism, and contributes to the fixation of the position of the latter.

To complete the casing 10, a circular cover 15 is flanged onto one end of the circular cylindrical tube through the interposition of a gasket or sealing ring 14. The axially displaceable shaft 16 is passed coaxially through the cover 15. At the other end of the circular cylindrical tube, to accommodate different cable connections, there is disposed an exchangeable adapter ring 17 onto which, through the interposition of a gasket or sealing ring 18, the insulating casing 19 of a conductor lead-in wire 20 is flanged; the insulating casing 19 projects conically into the casing 10. The cover 15 and the adapter ring 20 are each provided with an annular groove for receiving one end of the inner cylindrical sleeve 13.

Whereas the stationary contact piece 21 of the load disconnector 21, 22 is coaxially mounted on the inner end face of the conductor lead-in wire 20, the axially movable cooperating contact piece 22 of the load disconnector 21, 22 is coaxially mounted on the insulator core 23 of an insulator 23, 24 which comprises an insulator core 23 and an insulator casing 24; the insulator core 23 is axially displaceable via the shaft 16. With the exception of their respective connection ends, the contact piece 21 and the cooperating contact piece 22 are disposed in a circular cylindrical vacuum container 25.

the rotary contact 28 of the change-over switch 26, 27, 28 can be alternately switched between the phase contact 26 and the ground contact 27, and is disposed on the insulator 23, 24, which in turn is disposed between the shaft 16 and the axially movable cooperating contact piece 22 of the load disconnector 21, 22. Thus, the two successive switches 21, 22 and 26, 27, 28 not only have a common actuating element in the form of the axially displaceable shaft 16, but also have a common protecting element which keeps the electrical voltage away from the actuating mechanisms. As a result, not only can the actuating mechanisms of the load disconnector 21, 22 and of the change-over switch 26, 27, 28 be spaced closely together, but the two switches themselves can also be placed closely together, which further considerably reduces the space required for the switching mechanism, and further simplifies the removal and the installation of the two switches. In order, despite the physical grouping together of peripheral parts of the load disconnector 21, 22 and of the change-over switch 26, 27, 28, to achieve a separation of the different switching movements, and to advance the location of this separation as far as possible, the rotary contact 28 is excepted from the axial displacement movement of the shaft 16 by means of a concentric guide provided for the contact 28 on the insulator 23, 24; furthermore, the rotary contact 28 is connected to the axially movable cooperating contact piece 22 of the load disconnector 21, 22 by means of a flexible conductor or a sliding contact.

The shaft 16 is preferably passed through the casing 10 in the sealing seat remote from the cable connection 19, 20 on the side of the bus bar 11. As a result, it is possible to also use the space, required within the casing 10 for the bus bar 11, to a greater extend for accommodating switching parts. As shown in the drawing, this is realized in that the bus bar 11 is passed through the insulator 23, 24 at right angles thereto, the passage provided in the insulator 23, 24 for the bus bar 11 is widened to a slot 29 the length of which permits the axial switching movements of the cooperating contact piece 22 of the load disconnector 21, 22, the insulator 23, 24 is divided into an insulator core 23 which is axially symmetric to its axis and an insulator casing 24 which is rotatably mounted on the insulator core 23, and the passage provided in the insulator 23, 24 for the bus bar 11 is, in the vicinity of the insulating casing 24, again widened into two sector windows 30 which are offset relative to one another by 180°, and which have an angular aperture which permits the switching movements of the rotary contact 28.

In order to provide it with a particularly solid support, and in order to also be able to transfer stronger electrical currents, the phase contact 26 of the change-over switch 26, 27, 28 comprises a molded body which is passed through the insulator 23, 24 together with the bus bar 11, is attached along the length of the bus bar 11 with a wide contact surface, and is provided at both of its ends with a respective perpendicularly projecting contact finger 31. The phase contact 26 has a secondary function, which simplifies the construction and the assembly of the switching mechanism, in that the two ends of the molded body which forms the phase contact 26 are used as abutments for the cylindrical sleeve 13 of electrically insulating material; this sleeve 13 accommodates the change-over switch 26, 27, 28, the load disconnector 21, 22, and an intermediate space of the casing 10 which is made of electrically conductive material. On both of the abutments there is provided a fixing screw 32 which connects the cylindrical sleeve 13 with the phase contact 26. The head of a given fixing screw 32 can be reached via the respective branch provided in the casing 10 for the bus bar 11, is countersunk in the cylindrical sleeve 13, and is usually covered by an insulating sleeve 33 which can be shifted on the cylindrical sleeve 13. The connection of the phase contact 26 with the bus bar 11 is effected, for example, by two socket-head cap screws 34 which, parallel to the longitudinal axis of the switching mechanism, extend through the bus bar 11 in the region between the cylindrical sleeve 13 and the insulating casing 24, and are accessible from that side which faces the axially displaceable shaft 16.

In conformity with the heavy-current design of the phase contact 26, and to achieve a contribution to a higher operating reliability, a smaller space requirement, an economical manufacture, and a time saving maintenance, the ground contact 27 of the change-over switch 26, 27, 28 comprises two flat strips which are offset by 90° relative to the contact fingers 31 of the phase contact 26, extend externally of the insulator casing 24 parallel to its axis of rotation, and are joined to the shaft 16. By providing the rotary contact 28 of the change-over switch 26, 27, 28 with two ends which have the cross section of a double-pronged fork and which are designed for yielding, broad-sided enclosure of the contact fingers 31 of the phase contact 26, or of the similarly shaped free ends of the ground contact 27, and by movably guiding the narrow sides of the ends 35 of the rotary contacts between two respective vanes 36 which project out form the insulator casing 24, the heavy current usability of the rotary contact 28 is further improved, and the rotary contact 28 is exempted in a particularly simple manner from the axial switching movements of the insulator 23, 24 which is disposed between the cooperating contact piece 22 of the load disconnector 21, 22 and the shaft 16.

By means of an end collar 37, the axially displaceable shaft 16, which is provided as a common actuating element for the load disconnector 21, 22 and the change-over switch 26, 27, 28, is rotatably mounted on the end face of the insulator core 23 without axial play relative to the latter. To the side, next to the end collar 37, the shaft 16 is provided with radial arms 38, the outer ends of which are connected to the end face of the insulator casing 24. The cover 15, which completes the casing 10, has an outwardly projecting, central insert 39 which provides a better guidance for the axially displaceable shaft 16, and has place for more than one shaft seal 40. Beyond the casing 10, the shaft 16 ends with a drive wheel 41 which is connected to the latter and partially surrounds the insert 39. For the connection of the non-illustrated actuating mechanism of the load disconnector 21, 22, a coupling groove 42 is provided in the circumferential surface of the drive wheel 41. For the connection of the similarly non-illustrated actuating mechanism of the change-over switch 26, 27, 28, a pivot lever 43 is connected to the inner end face of the drive wheel 41. The installation of the described electrical, medium voltage, switching mechanism, for example in a transformer station or a distributor station, is finally accomplished by inserting a bus bar 11 through the switching mechanism and fastening it therein with screws, and by completing the casing 10 by flanging on tubular pieces which coaxially surround the bus bar 11.

The present invention is, of course, in no way restricted to the specific disclosure of the specification and drawings, but also encompasses any modifications within the scope of the appended claims.

What I claim is:

1. An electrical, medium voltage, switching mechanism, which includes a casing having a gaseous or liquid insulating material filling; in said casing, between a cable connection and a bus bar, a change-over switch, which can alternately switch between a phase contact and a ground contact, follows a load disconnector, which is in the form of a vacuum switching tube, and has a fixed contact piece and an axially movable cooperating contact piece;

the improvement comprising a common actuating element for both said load disconnector and said change-over switch, said actuating element being in the form of an axially displaceable shaft which is displaceable relative to said load disconnector and is rotatable relative to said change-over switch.

2. A switching mechanism according to claim 1, which includes an insulator interposed between said shaft and said axially movable cooperating contact piece of said load disconnector; and in which said change-over switch includes a rotary contact for effecting said alternate switching between said phase contact and said ground contact; said rotary contact is mounted on said insulator.

3. A switching mechanism according to claim 2, in which said insulator has a coaxial guide for said rotary contact for excepting the latter from the axial displacement movement of said shaft; and which includes one of a flexible conductor and a sliding contact for connecting said rotary contact to said axially movable cooperating contact piece of said load disconnector.

4. A switching mechanism according to claim 3, in which said casing has a sealing seat, through which said shaft is passed, on that side of said bus bar remote from said cable connection.

5. A switching mechanism according to claim 4, in which said bus bar passes through said insulator at right angles thereto, for which purpose said insulator is provided with a through passage which is widened into a slot having a length which permits the axial switching movements of said cooperating contact piece of said load disconnector; said insulator being divided into an insulator core which is axially symmetric to the axis of said insulator, and an insulator casing which is rotatably mounted on said insulator core; in the region of said insulator casing, said through passage for said bus bar is further widened into two sector windows which are offset from one another by 180° and have an angular aperture which permits the switching movements of said rotary contact.

6. A switching mechanism according to claim 5, in which said phase contact of said change-over switch comprises a molded body which passes through said insulator together with said bus bar; when viewed along its length, said molded body joins said bus bar with a broad contact surface, and has two ends, each of which has a perpendicularly projecting contact finger.

7. A switching mechanism according to claim 6, in which said molded body, which forms said phase contact, has two end faces, which form abutments for a cylindrical sleeve of electrically insulating material, said sleeve accommodating said change-over switch, said load disconnector, and an intermediate space of said casing, which comprises electrically conductive material.

8. A switching mechanism according to claim 6, in which said ground contact of said change-over switch comprises two flat strips which are offset by 90° relative to said contact fingers of said phase contact, extend parallel to the axis of rotation of said insulator casing externally thereof, and are joined on said shaft.

9. A switching mechanism according to claim 8, in which said rotary contact of said change-over switch has two ends designed for yielding broad-sided enclosure of said contact fingers of said phase contact, or of similarly shaped free ends of said ground contact, said rotary contact ends having the cross-sectional shape of a double-pronged fork, and having narrow sides which are respectively movably guided between two vanes which project out from said insulator casing.

* * * * *